US007138956B2

(12) United States Patent
Nilsson

(10) Patent No.: US 7,138,956 B2
(45) Date of Patent: Nov. 21, 2006

(54) APPARATUS AND METHOD FOR A MULTI-POLARIZED GROUND PLANE BEAM ANTENNA

(75) Inventor: Jack Nilsson, Medina, OH (US)

(73) Assignee: WiFi-Plus, Inc., Brunswick Hills, OH (US)

( * ) Notice: Subject to any disclaimer, the term of this patent is extended or adjusted under 35 U.S.C. 154(b) by 0 days.

(21) Appl. No.: 10/787,025

(22) Filed: Feb. 25, 2004

(65) Prior Publication Data

US 2004/0164919 A1 Aug. 26, 2004

Related U.S. Application Data

(63) Continuation-in-part of application No. 10/294,420, filed on Nov. 14, 2002, now Pat. No. 6,806,841.

(51) Int. Cl.
*H01Q 19/00* (2006.01)
*H01Q 1/38* (2006.01)

(52) U.S. Cl. ..... 343/833; 343/700 MS

(58) Field of Classification Search ..... 343/718, 343/790, 818, 819, 824, 829, 833, 834, 847, 343/888, 904, 700 MS
See application file for complete search history.

(56) References Cited

U.S. PATENT DOCUMENTS

| | | | | |
|---|---|---|---|---|
| 2,218,707 A | | 10/1940 | Franz | |
| 3,383,694 A | | 5/1968 | Strohmeyer, Jr. | |
| 3,846,799 A | * | 11/1974 | Gueguen | 343/833 |
| 4,253,099 A | | 2/1981 | Yamazaki et al. | |
| 4,633,265 A | * | 12/1986 | Wheeler | 343/797 |
| 4,958,167 A | | 9/1990 | Schroeder | |
| 5,406,295 A | | 4/1995 | Baranski et al. | |
| 5,561,439 A | * | 10/1996 | Moilanen | 343/846 |
| 5,805,113 A | | 9/1998 | Ogino et al. | |
| 5,990,845 A | * | 11/1999 | Sharp et al. | 343/846 |
| 6,100,855 A | * | 8/2000 | Vinson et al. | 343/846 |
| 6,407,719 B1 | * | 6/2002 | Ohira et al. | 343/893 |

OTHER PUBLICATIONS

HTTP://WWW.MAGNETICSCIENCES.COM/UWBANDVPOLANTS ~ NS4.HTML, "Ultra-Wideband (UWB) and Multiband antenna for RF, microwaves and UWB,".

HTTP://WWW.MAGNETICSCIENCES.COM/MULTIBEAMSATCOMANTENNA~NS4.HTLM, "Multiple Beam Antenna for Satellite Communications and LOS Communications,".

HTTP://WWW.NORTHCOUNTRYRADIO.COM/ARTICLES/DISCFIG2.HTM, "Discone Figures,".

(Continued)

*Primary Examiner*—Don Wong
*Assistant Examiner*—Marie Antoinette Cabucos
(74) *Attorney, Agent, or Firm*—Sheldon Mak Rose & Anderson PC

(57) ABSTRACT

A ground plane beam antenna for transmitting and/or receiving radio frequency (RF) signals, and a method for constructing same, is disclosed. An embodiment of the antenna comprises at least one parasitic reflector element having a first end and a second end, at least one parasitic director element having a first end and a second end, a multi-polarized driven element positioned co-linearly with and between the at least one reflector element and the at least one director element, and an electrically conductive ground plane. The ground plane is electrically connected to the at least one reflector element and the at least one director element at the second ends, and is electrically isolated from the driven element.

35 Claims, 12 Drawing Sheets

4-element beam antenna
with a multi-polarized tri-element driver

OTHER PUBLICATIONS

HTTP://KYLETI.ASWWC.NET/INDEX.PHP?PAGE=PROJECTS&OLD_PROJECT+80211B_DISCONE, "Tim and David's 2.4 GHz802.11b Discone,".

HTTP://WWW.WAVE-REPORT.COM/TUTORIALS/OFDM.HTM, "OFDM Tutorial,".

Broadband Wireless Internet Forum White Paper, "VOFDM Broadband Wireless Transmission and Its Advantages over Single Carrier Modulation; Document No. WP-1_TG-1," Broadband WIreless Internet Forum, 1.2 ed., Broadband WIreless Internet Forum, p. 1-35, (Dec. 15, 2000).

* cited by examiner 4-element beam antenna
with a multi-polarized tri-element driver re-adjustment of antenna elements $$D_{1(\text{adjusted})} = 0.95*[984/f(\text{MHz})]*(1/4)*(12)*(\text{k-factor}) * [1-[(1-P)_{\text{of } 0.45\lambda} * (1.1/0.95)]] * [1-[(1-P)_{\text{of } 0.20\lambda} * (1.0/0.95)]] * [1-[(1-P)_{\text{of } 0.22\lambda} * (0.9/0.95)]]$$

where $D_r = ¼*[984/f(\text{MHz})]*12 = 1/4\lambda$ in inches (1-P) CURVE

For odd > 1:

- the spacing between director elements $D_{odd}$ and $D_{odd-1}$ is greater than the spacing between director elements $D_{odd-1}$ and $D_{odd-2}$
- the length ($D_{odd}$ - $D_{odd-1}$) is less than the length ½ ($D_{odd-2}$ - $D_{odd-1}$)
- the spacing between director elements $D_{odd}$ and $D_{odd-1}$, and $D_{odd-2}$ and $D_{odd-1}$ increase the further the director elements get from the driven element $D_r$

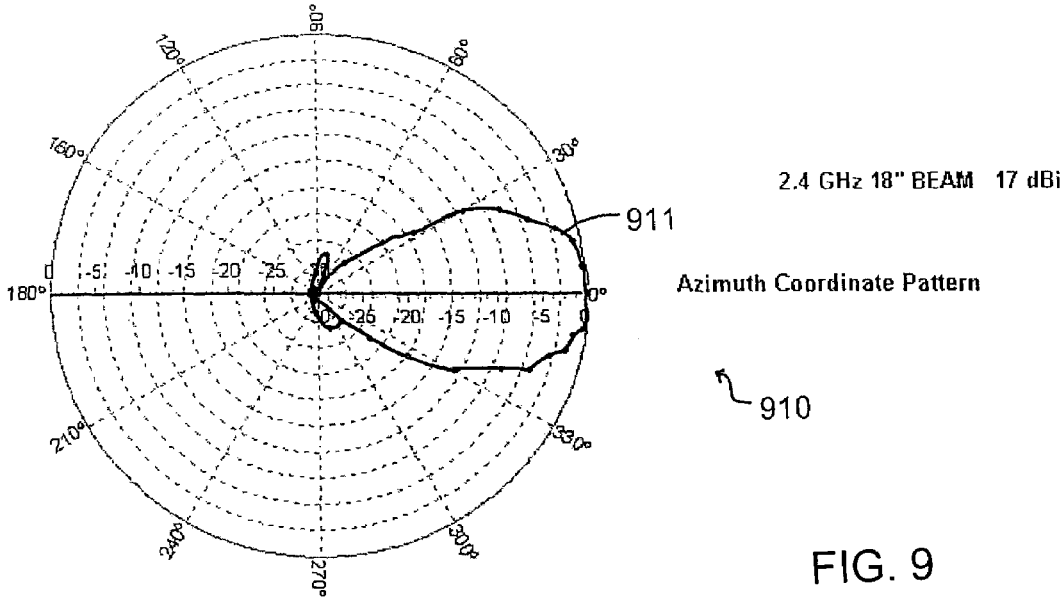
FIG. 9
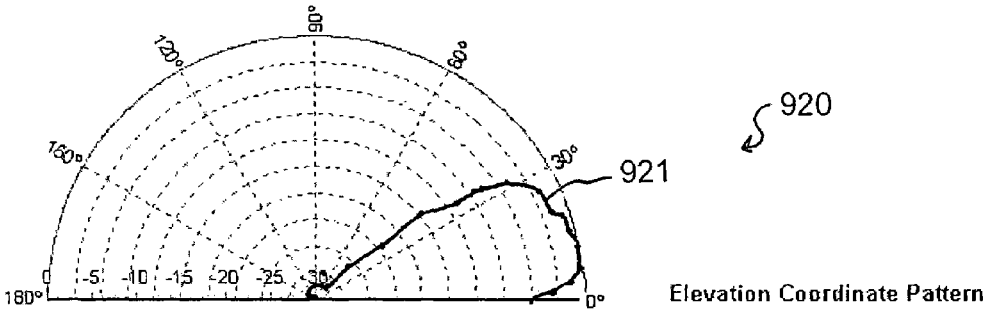

FIG. 10A
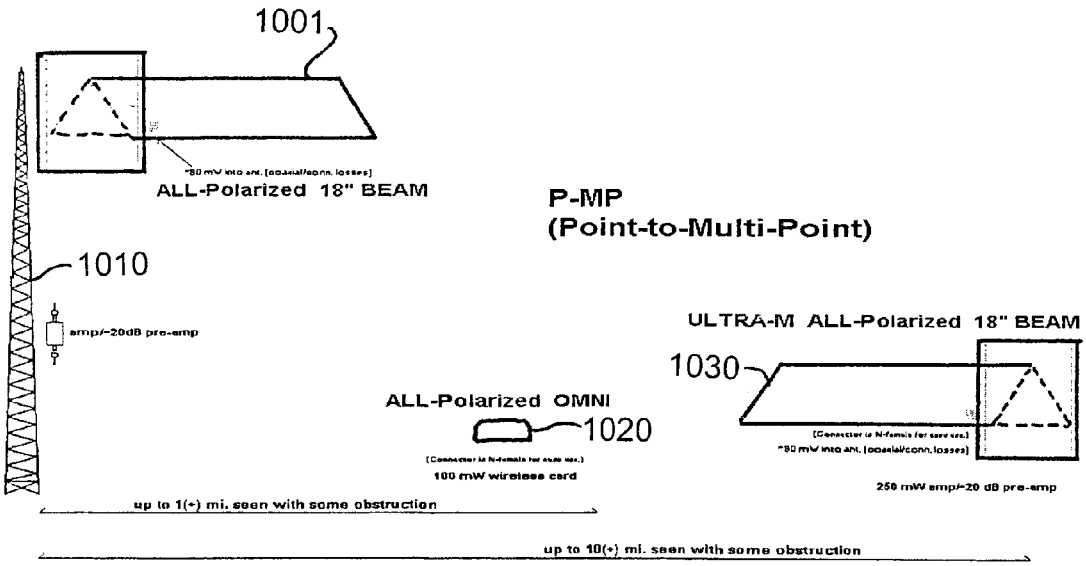
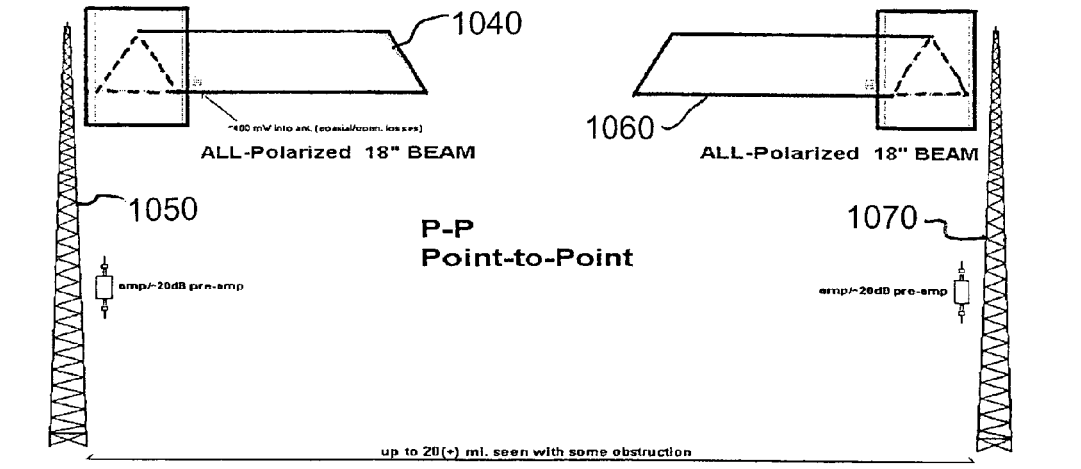
FIG. 10B

APPARATUS AND METHOD FOR A MULTI-POLARIZED GROUND PLANE BEAM ANTENNA

CROSS-REFERENCE TO RELATED APPLICATIONS/INCORPORATION BY REFERENCE

This application is a continuation-in-part (C-I-P) of patent application Ser. No. 10/294,420 filed on Nov. 14, 2002, now U.S. Pat. No. 6,806,841 which is incorporated herein by reference in its entirety.

U.S. application Ser. No. 10/787,031 entitled "Apparatus and Method for a Multi-Polarized Antenna" and filed on the same day as the application herein, is incorporated herein by reference in its entirety.

U.S. Pat. No. 6,496,152 issued on Dec. 17, 2002 is incorporated herein by reference in its entirety.

TECHNICAL FIELD

Certain embodiments of the present invention relate to antennas for wireless communications. More particularly, certain embodiments of the present invention relate to an apparatus and method providing a multi-polarized ground plane beam antenna exhibiting substantial spatial diversity for use in point-to-point and point-to-multipoint communication applications for the Internet, maritime, aviation, and space.

BACKGROUND OF THE INVENTION

For years, wireless communications have struggled with limitations of audio/video/data transport and internet connectivity in both obstructed (indoor/outdoor) and line-of-site (LOS) deployments.

A focus on antenna gain as well as circuitry solutions have proven to have significant limitations. Unresolved, non-optimized (leading edge) technologies have often given way to "bleeding edge" attempted resolutions. Unfortunately, all have fallen short of desirable goals, and some ventures/companies have even gone out of business as a result.

While lower frequency radio waves benefit from an 'earth hugging' propagation advantage, higher frequencies do inherently benefit from (multi-) reflection/penetrating characteristics. However, with topographical changes (hills & valleys) and object obstructions (e.g., natural such as trees, and man-made such as buildings/walls) and with the resultant reflections, diffractions, refractions and scattering, maximum signal received may well be off-axis (non-direct path) and multi-path (partial) cancellation of signals results in null/weaker spots. Also, some antennas may benefit from having gain at one elevation angle ('capturing' signals of some pathways), while other antennas have greater gain at another elevation angle, each type being insufficient where the other does well. In addition, the radio wave can experience altered polarizations as they propagate, reflect, refract, diffract, and scatter. A very preferred (polarization) path may exist, however, insufficient capture of the signal can result if this preferred path is not utilized.

Spatial diversity can distinctly help with some of the null-spot issues. Some radio equipment comes equipped with two switched antenna connections to reduce null spot problems experienced by a single antenna due to multi-path signals. A single antenna may receive signals out of phase from different paths, causing the resultant received signal to be nulled out (i.e., the individual signals received from the different paths cancel each other out). With two antennas, if one antenna is experiencing null cancellation, the other, if positioned properly with respect to the first antenna, will not. VOFDM (Vector Orthogonal Frequency Division Multiplexing) technology helps with some multi-path out-of-phase 'data clash' issues. Electronically steer-able antenna arrays alleviate some interference problems and provide a solution where multiple standard directional antenna/radio systems would otherwise be more difficult or clearly impractical. Dual slant polarization antenna/circuitry switching systems have shown much advantage over others in (some) obstructed environments but require additional complex circuitry. Circularly polarized systems can also provide some penetration advantages.

Certainly, gain (increased ability to transmit and receive signals in a particular direction) is important. However, if polarization of the signal and antenna are not matched, poor performance may likely result. For example, if the transmitting antenna is vertically polarized and the receiving antenna is also vertically polarized, then the transmitting and receiving antennas are matched for wireless communications. This is also true for horizontally polarized transmitting and receiving antennas.

However, if a first antenna is horizontally polarized (e.g., a TV house antenna) and a second antenna (e.g., TV transmitting antenna) is vertically polarized, then the signal received by the first antenna will be reduced, due to polarization mismatch, by about 20 dB (to about $1/100^{th}$ of the signal that could be received if polarizations were matched). For example, a vertically polarized antenna with 21 dBi of gain, attempting to receive a nearly horizontally polarized signal, is essentially a 1 dBi gain antenna with respect to the horizontally polarized signal and may not be effective.

As another example, a vertically or horizontally polarized antenna that is tilted at 45 degrees can receive both vertically and horizontally polarized signals, but at a power loss of 3 dB (½ power). However, if the signal to be received is also at a 45-degree tilt, but perpendicular to the 45-degree tilt of the receiving antenna, then the signal is again reduced to $1/100^{th}$ of the potential received signal. Having two antennas where one is vertically polarized and the other is horizontally polarized can help, but still has its disadvantages. Therefore, gain is important but, to be effective, polarization should be considered as well.

Traditional beam antennas such as, for example, the Yagi-Uda antenna, the quad-beam antenna, and the quagi antenna, provide higher gain substantially in one direction. Beam antennas are often desirable where transmission and reception along primarily one direction is desired such as, for example, communication between two spatially separated towers, or between a tower and customer premise equipment (CPE).

The Yagi-Uda and quagi antennas use a reflector element positioned behind a driven element, and director elements positioned in front of the driven element. All of the elements are co-linear (i.e., positioned along an imaginary line in space). A focused beam of electromagnetic energy is formed in the far field along the co-linear direction. However, such antennas tend to suffer from a poor ability to receive signals of many different polarizations and have limited spatial diversity.

Further limitations and disadvantages of conventional, traditional, and proposed approaches will become apparent to one of skill in the art, through comparison of such systems with the present invention as set forth in the remainder of the present application with reference to the drawings.

BRIEF SUMMARY OF THE INVENTION

An embodiment of the present invention provides an apparatus comprising a ground plane beam antenna for transmitting and/or receiving radio frequency (RF) signals. The antenna comprises at least one parasitic reflector element having a first end and a second end, at least one parasitic director element having a first end and a second end, a driven element positioned co-linearly with and between the at least one reflector element and the at least one director element, and an electrically conductive ground plane. The ground plane is electrically connected to the reflector element and the at least one director element at the second ends, and is electrically isolated from the driven element.

An embodiment of the present invention includes a method to construct a ground plane beam antenna for transmitting and/or receiving radio frequency (RF) signals. The method includes generating a driven element that is tuned to at least one predetermined radio frequency. The method further includes generating at least one linear, parasitic reflector element having a first end and a second end and having an initial length based on, at least in part, the tuned driven element. The method also includes generating at least one linear, parasitic director element having a first end and a second end and having an initial length based on, at least in part, the tuned driven element. The method further includes positioning the driven element co-linearly with and between the reflector element and the at least one director element. The method also includes generating an electrically conductive ground plan and electrically connecting the ground plane to the second ends of the reflector element and the at least one director element, and keeping the ground plane electrically isolated from the driven element.

An embodiment of the present invention includes a stacked configuration of ground plane beam antennas for improving gain along a particular spatial direction. The stacked configuration comprises at least four ground plane beam antennas positioned in spatial proximity to each other and having substantially the same spatial orientation. The antennas each comprise at least one parasitic reflector element having a first end and a second end, at least one parasitic director element having a first end and a second end, a driven element positioned co-linearly with and between the reflector element and the at least one director element, and an electrically conductive ground plane connected to the at least one reflector element and the at least one director element at the second ends. The ground plane is electrically isolated from the driven element.

An embodiment of the present invention includes a antenna configuration for transmitting and/or receiving radio frequency (RF) signals. The configuration comprises a conductive reflector plate and a first ground plane beam antenna mounted onto a first side of the conductive reflector plate such that RF radiation from the first ground plane beam antenna is directed substantially perpendicular to and away from the first side of said conductive reflector plate. The configuration further comprises a second ground plane beam antenna, being substantially identical to the first ground plane beam antenna, and being mounted onto the first side of the reflector plate such that RF radiation from the second ground plane beam antenna is directed substantially perpendicular to and away from the first side of the conductive reflector plate. The configuration also includes a two-port power divider to feed a radio frequency signal in phase to both the first ground plane beam antenna and the second ground plane beam antenna.

These and other advantages and novel features of the present invention, as well as details of an illustrated embodiment thereof, will be more fully understood from the following description and drawings.

BRIEF DESCRIPTION OF SEVERAL VIEWS OF THE DRAWINGS

FIG. 9 is a graphical illustration of the azimuth and elevation beam patterns generated by the antenna of FIG. 7, in accordance with various aspects of the present invention.

FIGS. 10A and 10B illustrate point-to-point and point-to-multipoint applications using the antenna of FIG. 7, in accordance with various aspects of the present invention.

DETAILED DESCRIPTION OF THE INVENTION

Figure 1:
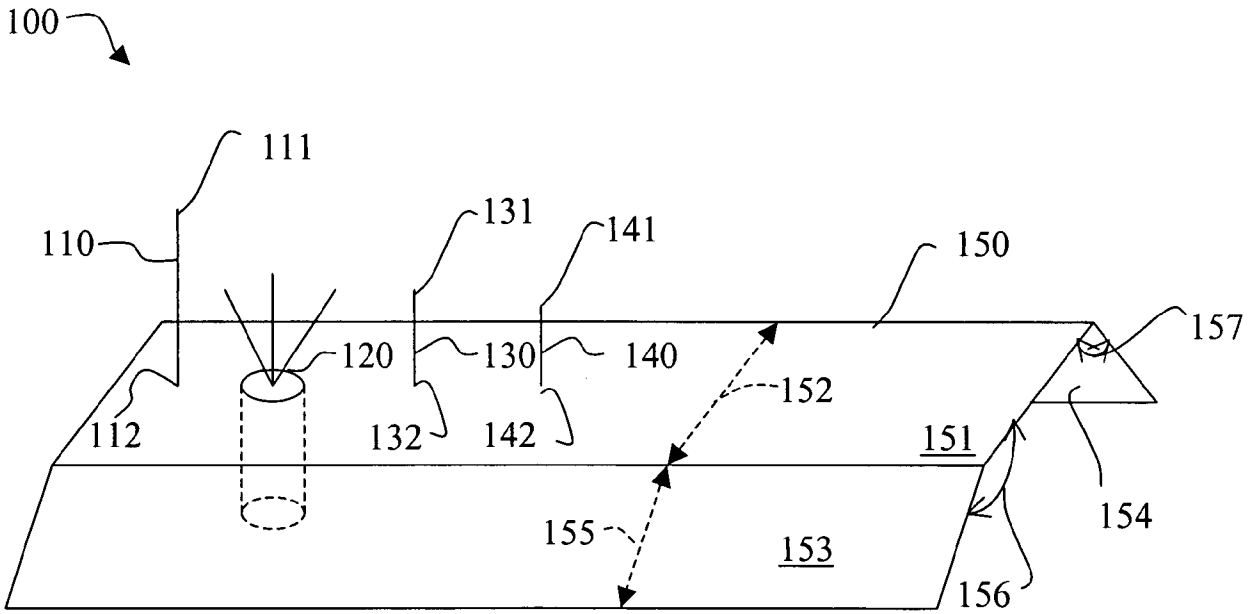
FIG. 1 illustrates a first embodiment of a multi-polarized ground plane beam antenna, in accordance with various aspects of the present invention.

FIG. 1 illustrates a first embodiment of a multi-polarized ground plane beam antenna 100, in accordance with various aspects of the present invention. The antenna 100 comprises a parasitic reflector element 110, a multi-polarized driven element 120, a first parasitic director element 130, a second parasitic director element 140, and an electrically conductive ground plane 150. The parasitic reflector element 110 includes a first end 111 and a second end 112. The first parasitic director element 130 includes a first end 131 and a second end 132. The second parasitic director element 140 includes a first end 141 and a second end 142. As defined herein, parasitic means not directly driven by a radio frequency signal.

Other embodiments of the present invention may comprise a driven element and a single reflector plate, a driven element and a single tuned reflector element, a driven element and a single tuned director element, or any combination thereof.

Figure 2:
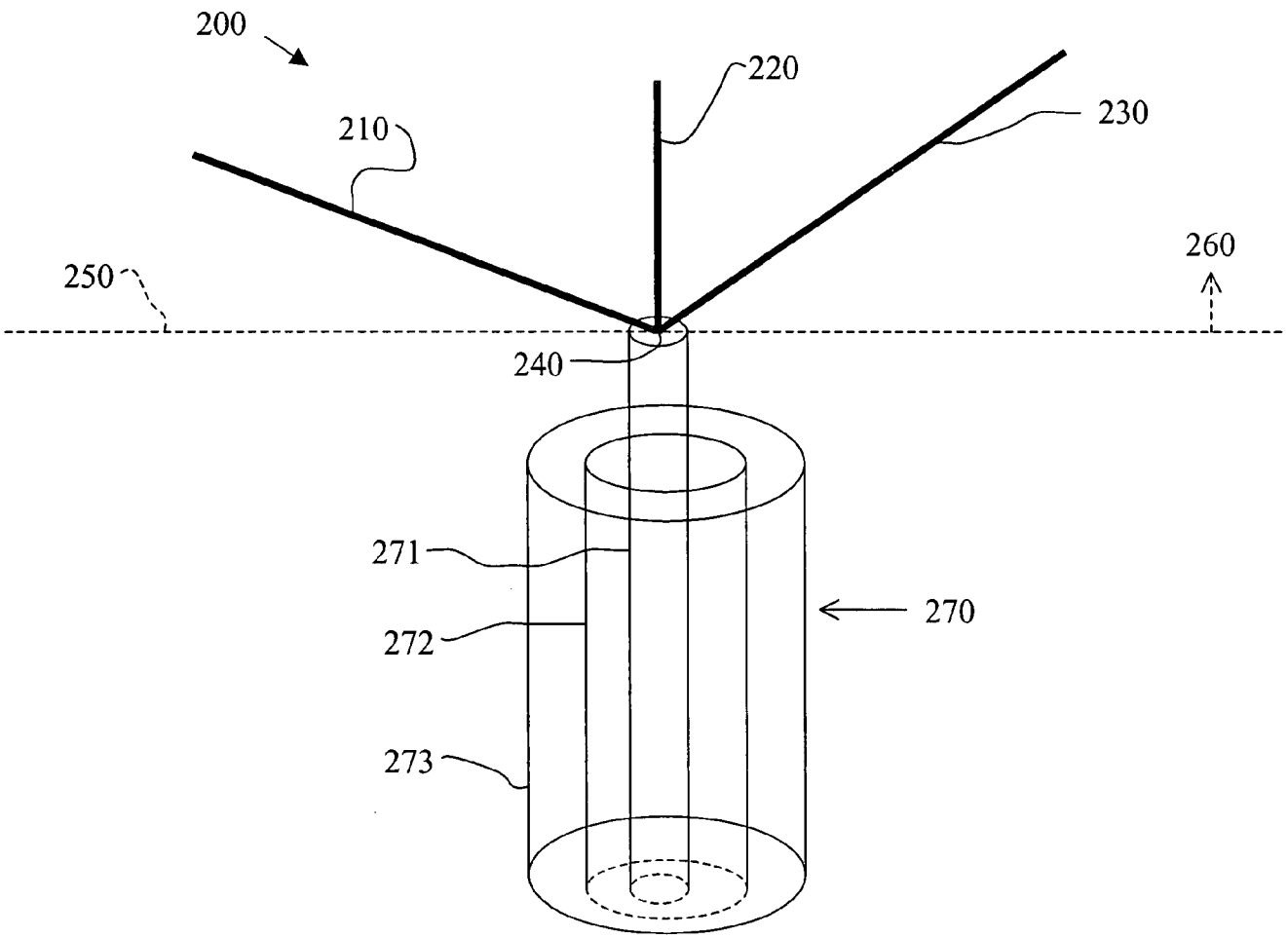
FIG. 2 illustrates a multi-polarized driven element used in the antenna of FIG. 1, in accordance with an embodiment of the present invention.

FIG. 2 illustrates a multi-polarized driven element 200 used in the antenna 100 of FIG. 1, in accordance with an embodiment of the present invention. The multi-polarized driven element 200 comprises a first radiative member 210, a second radiative member 220, and a third radiative member 230. The three radiative members 210, 220, and 230 of the driven element 200 are electrically connected together at an apex point 240 such that the three radiative members 210, 220, and 230 are each disposed outwardly away from the apex point 240 at an acute angle of between 1 degree and 89 degrees relative to an imaginary plane 250 intersecting the apex point 240. The radiative members 210, 220, and 230 are all located to a first side 260 of the imaginary plane 250.

When multiple radiative members (e.g., three) are positioned over a ground plane and properly spaced, many more polarizations may be generated and/or received in many more different directions. Therefore, such a driven element is said to be "'multi-polarized" as well as providing "geometric spatial capture of signal". If a driven element produced all polarizations in all planes (i.e., all planes in an x, y, z coordinate system) and the receiving antenna is capable of capturing all polarizations in all planes, then the significantly greatest preferred polarization path (maximum amplitude signal path) may be availably utilized.

Electromagnetic waves are often reflected, diffracted, refracted, and scattered by surrounding objects, both natural and man-made. As a result, electromagnetic waves that are approaching a receiving antenna can be arriving from multiple angles and have multiple polarizations and signal levels. The antenna 100 of FIG. 1 is able to capture or utilize the preferred approaching signal whether the preferred signal is a line-of-sight (LOS) signal or a reflected signal, and no matter how the signal is polarized.

In accordance with an embodiment of the present invention, each radiative member 210, 220, and 230 is conductive and is substantially linear, coiled or not, and having two ends. The length of each radiative member 210, 220, and 230 is "cut" to be tuned to a predetermined radio frequency. Each radiative member 210, 220, and 230 may be cut to the same predetermined radio frequency or to differing radio frequencies, in accordance with various aspects of the present invention. For example, in accordance with an embodiment of the present invention, each radiative member 210, 220, and 230 is cut to a physical length that is approximately one-quarter wavelength of a desired radio frequency of transmission. Also, the radiative elements may be "cut" to establish a specific impedance of the driven element 200 at a particular radio frequency based on capacitive, inductive, and resistive interactions between the radiative elements 210, 220, and 230. Each radiative member 210, 220, and 230 may be at a unique acute angle or at the same acute angle relative to the imaginary plane 250. In accordance with an embodiment of the present invention, the three radiative members 210, 220, and 230 are spaced circumferentially at 120 degrees from each other. Other spacings are possible as well.

In accordance with an embodiment of the present invention, the multi-polarized driven element 200 includes an electrical connector (e.g., a coaxial connector) 270 which comprises a center conductor 271, an insulating dielectric region 272, and an outer conductor 273. The electrical connector 270 serves to mechanically connect the three radiative members 210, 220, and 230 to the ground plane 150 and to allow electrical connection of the radiative members 210, 220, and 230 and the ground plane 150 to a transmission line for interfacing to a radio frequency (RF) transmitter and/or receiver.

For example, the center conductor 271 electrically connects to the apex 240 of the radiative members 210, 220, and 230 and the outer conductor 273 electrically connects to the ground plane 150. The insulating dielectric region 272 electrically isolates the center conductor 240 (and therefore the radiative members 210, 220, and 230) from the outer conductor 273 (and therefore from the ground plane 150). The insulating dielectric region 272 may also serve to mechanically connect the radiative members 210, 220, and 230 to the ground plane 150, in accordance with an embodiment of the present invention.

In accordance with other embodiments of the present invention, the number of radiative members may be only two or may be greater than three. For example, four radiative members circumferentially spaced at 90 degrees, or otherwise, may be used. In fact, a large number of radiative members may be effectively replaced with a continuous surface of a cone, a pyramid, or some other continuous shape that is spatially diverse on one side (i.e., has significant spatial extent) and comes substantially to a point (e.g., an apex) on the other side. For example, in accordance with an embodiment of the present invention, a linear radiative member connected at one end to a radiative loop having a certain spatial extend may be used.

Figure 3:
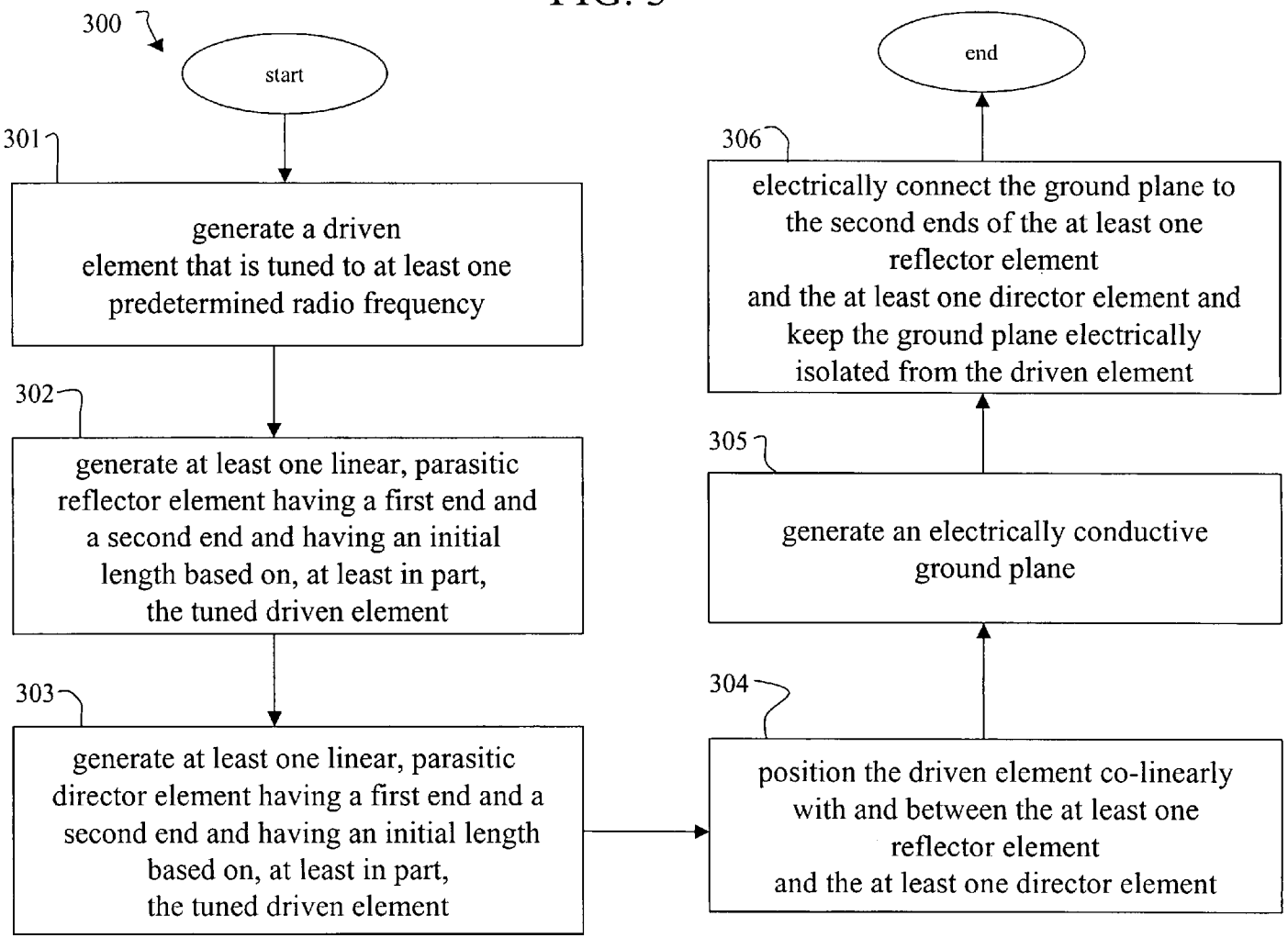
FIG. 3 is a flowchart of an embodiment of a method to construct the antenna of FIG. 1, in accordance with various aspects of the present invention.

FIG. 3 is a flowchart of an embodiment of a method 300 to construct the antenna of FIG. 1, in accordance with various aspects of the present invention. In step 301, a driven element is generated which is tuned to at least one predetermined radio frequency. In step 302, at least one linear parasitic reflector element is generated having a first end and a second end and having an initial length based on, at least in part, the tuned driven element. In step 303, at least one linear parasitic director element is generated having a first end and a second end and having an initial length based on, at least in part, the tuned driven element. In step 304, the driven element is positioned co-linearly with and between the reflector element and the at least one director element. In step 305, an electrically conductive ground plane is generated. In step 306, the ground plane is electrically connected to the second ends of the at least one reflector element and the at least one director element such that the ground plane is kept electrically isolated from the driven element.

In accordance with an alternative embodiment of the present invention, the ground plane may be electrically isolated from the reflector elements and the director elements.

As an example, referring to FIG. 1, the multi-polarized driven element 120 is generated as in FIG. 2. The reflector element 110, driven element 120, first director element 130, and second director element 140 are positioned co-linearly with respect to each other such that the driven element 120 is between the reflector element 110 and the first director element 130. The electrically conductive ground plane 150 is generated comprising a substantially rectangular, first conductive sheet 151 having a width of generally about ¼ wavelength of a tuned radio frequency (e.g., the tuned radio frequency of the driven element) and is positioned substantially parallel to the imaginary plane 250 of FIG. 2. The first conductive sheet 151 may comprise a metal sheet such as, for example, copper. The second ends 112, 132, and 142 of the reflector and director elements 110, 130, and 140 are electrically connected (e.g., welded and/or soldered) to the conductive sheet 151 of the ground plane 150. The connector 270 of the driven element 200 may pass through a hole in the conductive sheet 151.

The ground plane 150 further comprises substantially rectangular second 153 and third 154 conductive sheets, each having a width 155 of generally about ¼ wavelength of the tuned radio frequency. One-half of width 152 plus width 155 is at least ¼ wavelength, in accordance with an embodiment of the present invention, for best performance. Each conductive sheet 153 and 154 is substantially the same length as the first conductive sheet 151. The second conductive sheet 153 has a first lengthwise edge that is mechanically and electrically connected to a first lengthwise edge of the first conductive sheet 151, as shown in FIG. 1, and forms an angle 156 with respect to the first conductive sheet 151. The third conductive sheet 154 has a first lengthwise edge that is mechanically and electrically connected to a second lengthwise edge of the first conductive sheet 151, and forms an angle 157 with respect to the first conductive sheet 151. The conductive sheet 151 and second and third angled conductive sheets 153 and 154 help to increase gain and shape the resultant beam pattern of the antenna 100, minimizing the side lobes. Also, angle 157 helps further multi-polarization characteristics (and gain/pattern).

In accordance with an embodiment of the present invention, the antenna 100 of FIG. 1 may be enclosed in a protective housing that is transparent to electromagnetic waves. This helps to protect the antenna 100 from various detrimental environmental effects due to, for example, wind and rain.

In accordance with an alternative embodiment of the present invention, the driven element may comprise a single linear radiative member or some other type of driven element having one or more radiative members.

Figure 4:
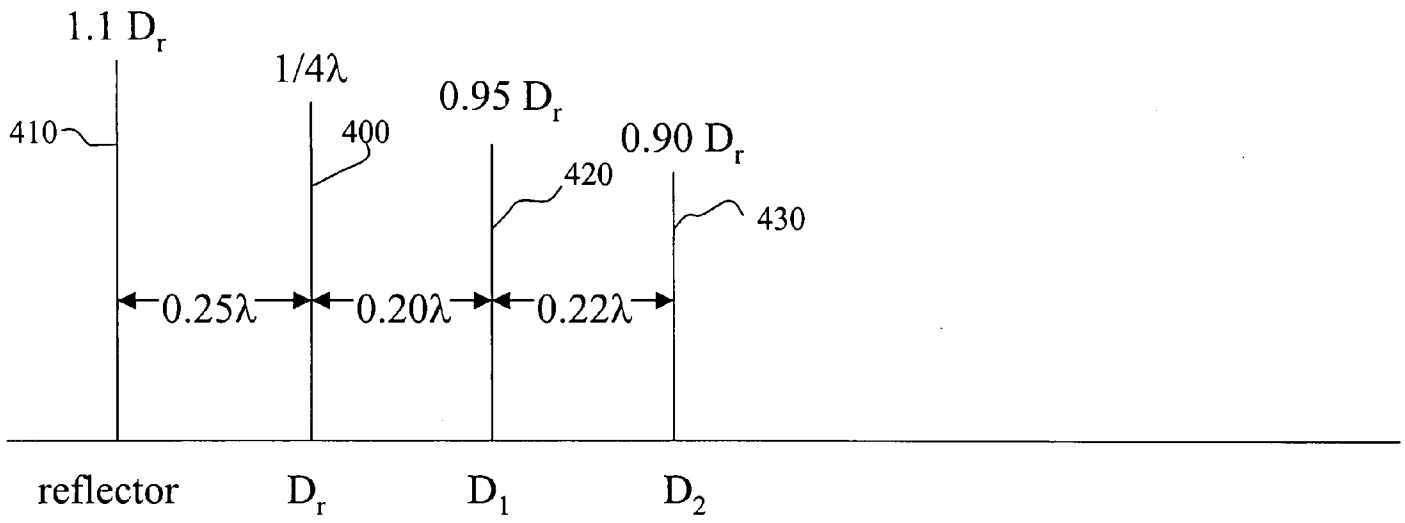
FIG. 4 is an exemplary illustration of a method to re-adjust the length of an antenna element of the antenna of FIG. 1, in accordance with an embodiment of the present invention.

FIG. 4 is an exemplary illustration of a method to re-adjust the length of an antenna element of the antenna 100 of FIG. 1, in accordance with an embodiment of the present invention. In general, when constructing the antenna 100 of FIG. 1, the driven element $D_r$ 400 (referring to FIG. 4) is tuned to be a quarter wavelength of a desired radio frequency of transmission and/or reception. Based on traditional Yagi-Uda antenna design theory, the length of the reflector element 410 is made a little longer than the driven element $D_r$ 400 (e.g., reflector=1.1 $D_r$). The length of the first director element $D_1$ 420 is made a little shorter than the driven element $D_r$ 400 (e.g., $D_1$=0.95 $D_r$). Finally, the length of the second director element D2 430 is made a little shorter than $D_1$ (e.g., $D_2$=0.90 $D_r$).

Based on traditional Yagi-Uda design techniques, the spacing between the various elements may be one-quarter wavelength (i.e., 0.25λ). For example, the spacing between the reflector element 410 and the driven element 400 may be one-quarter wavelength (i.e., 0.25λ). These spacings may be optimized further through trial-and-error experimentation, if desired. For example, the spacing between the driven element $D_r$ 400 and the first director element $D_1$ 420 may, optimally, be shorter (e.g., 0.20λ) than one-quarter wavelength. Finally, the spacing between the first director element $D_1$ 420 and the second director element 430 $D_2$ may, optimally, be a little shorter (e.g., 0.22λ) than one-quarter wavelength.

The antenna elements 400, 410, 420, and 430 interact with each other, electromagnetically, and their lengths may be further optimized to account for this electromagnetic interaction, in accordance with an embodiment of the present invention. To re-adjust the antenna element lengths, the relative initial lengths of the antenna elements are taken into account as well as a K-factor and a (1-P) parameter.

Figure 5:
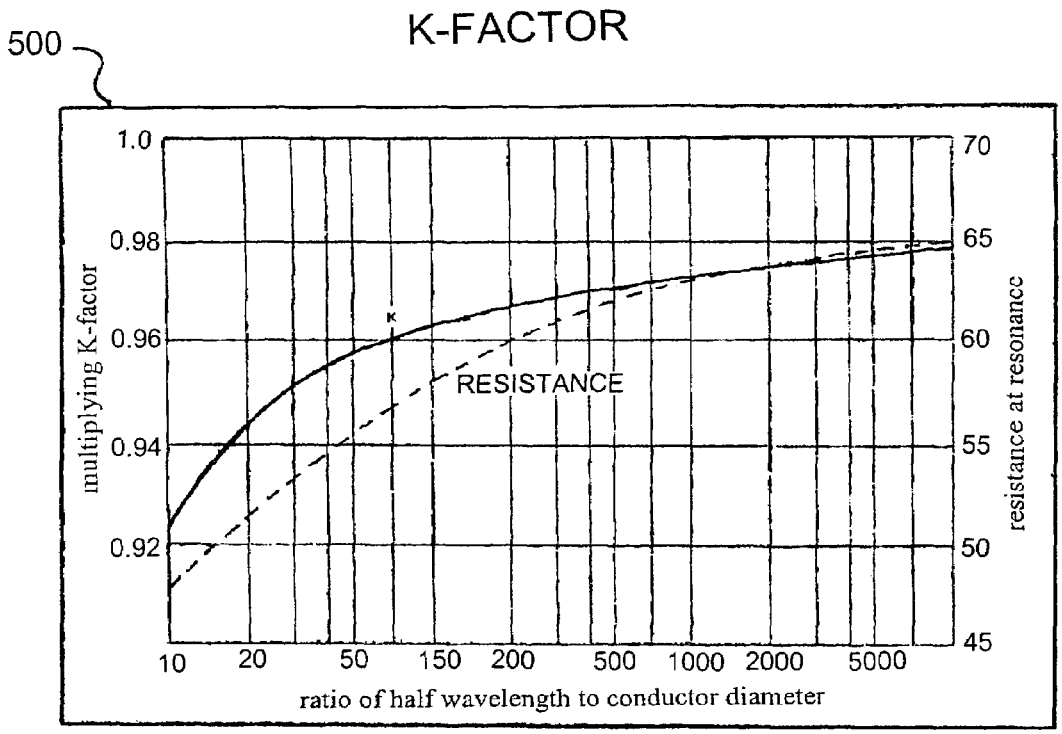
FIG. 5 illustrates a graph of the K-factor used to adjust an element of the antenna of FIG. 1 using the method of FIG. 4, in accordance with various aspects of the present invention.

FIG. 5 illustrates a graph 500 of the K-factor used to adjust an element of the antenna of FIG. 1 using the method illustrated in FIG. 4, in accordance with various aspects of the present invention. The K-factor is a multiplying factor that accounts for the thickness or diameter of the antenna element with respect to a half wavelength of a desired frequency of transmission and/or reception. For example, referring to FIG. 5, if the ratio of a half wavelength to the diameter of a conductive antenna element is 500, then the corresponding K-factor is about 0.97 as taken from the graph 500.

Figure 6:
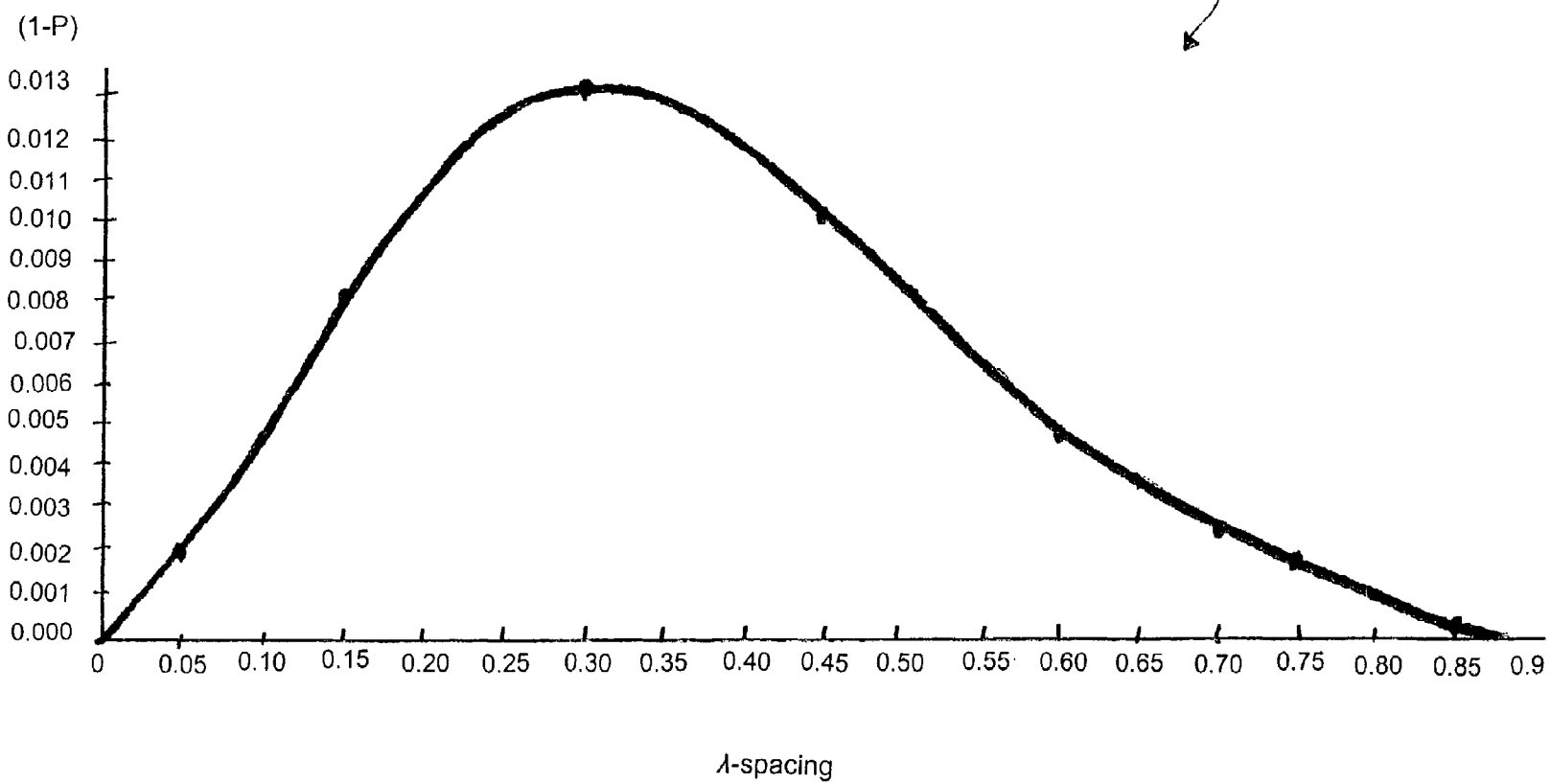
FIG. 6 illustrates a graph of the (1-P) parameter used to adjust an element of the antenna of FIG. 1 using the method of FIG. 4, in accordance with various aspects of the present invention.

FIG. 6 illustrates a graph 600 of the (1-P) parameter used to adjust an element of the antenna of FIG. 1 using the method of FIG. 4, in accordance with various aspects of the present invention. The (1-P) parameter is used to account for the spacing between two electromagnetically interacting antenna elements. For example, if the spacing between a first antenna element and a second antenna element is 0.25λ, then the corresponding (1-P) parameter is about 0.0125 as taken from the graph 600.

For example, referring again to FIG. 4, the initial length of antenna element $D_1$ is 0.95 $D_r$ where $D_r$ ¼*[984/f(MHz)]*12=¼λ (in units of inches). The term f(MHz) is the frequency in megahertz corresponding to the wavelength λ. To re-adjust the length of antenna element $D_1$ to account for the diameter of $D_1$ and the electromagnetic interactions between $D_1$ and the other antenna elements, the following computation is made:

$$D_{1(adjusted)}=0.95*[984/f(MHz)]*(1/4)*(12)*(\text{K-factor})*[1-[(1-P)_{of0.45\lambda}*(1.1/0.95)]]*[1-[(1-P)_{of0.20\lambda}*(1.0/0.95)]]*[1-[(1-P)_{of0.22\lambda}*(0.90/0.95)]]$$

The first line of the computation takes the initial length of $D_1$ and multiplies it by the K-factor to adjust the length of $D_1$ to account for the effects of the diameter of $D_1$. The second line of the computation accounts for the electromagnetic interaction between $D_1$ and the reflector 410 using the (1-P) parameter based on the spacing of 0.45λ between $D_1$ and the reflector 410, and the ratio of initial lengths between the reflector element 410 and $D_1$ (i.e., 1.1/0.95). Similarly, the third line of the computation accounts for the electromagnetic interaction between $D_1$ and the driven element $D_r$ based on the spacing of 0.20λ between $D_1$ and the reflector $D_r$ and the ratio of initial lengths. Finally, the fourth line of the computation accounts for the electromagnetic interaction between $D_1$ and $D_2$ based on the spacing of 0.22λ between $D_1$ and $D_2$ and the ratio of initial lengths.

As a result, $D_{1(adjusted)}$ is the final optimized length of antenna element $D_1$. In general, the lengths of all the antenna elements 400, 410, 420, and 430 may be re-adjusted in an iterative manner, using the method illustrated in FIG. 4, until a final optimized configuration is reached that gives the desired performance. From a practical point of view, the iterative optimization is performed on a computer using computer simulations of the antenna design. Once the final design is achieved on the computer, the actual antenna elements may be cut to the resultant optimal lengths.

Figure 7:
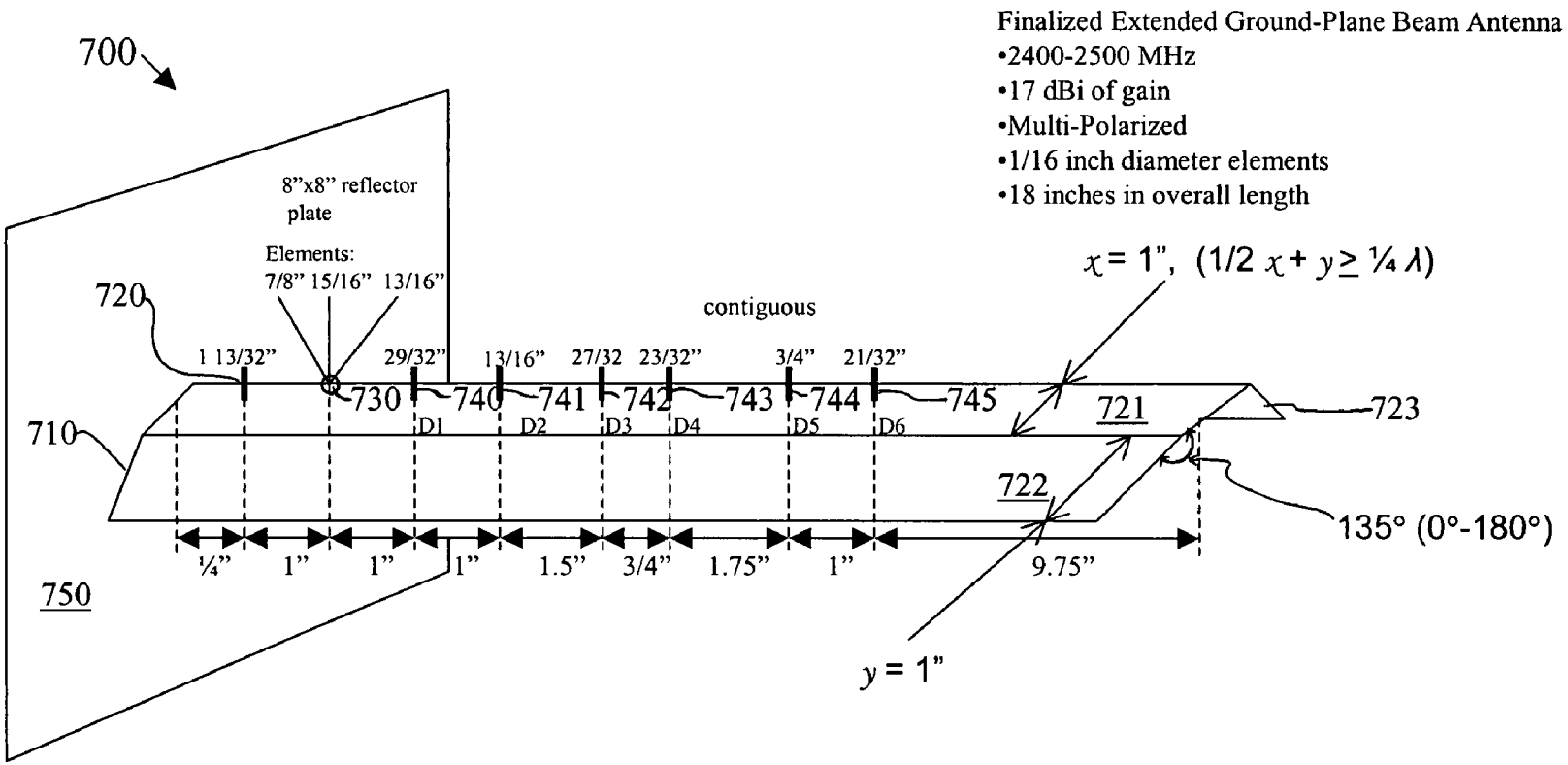
FIG. 7 illustrates a second embodiment of a multi-polarized ground plane beam antenna, in accordance with various aspects of the present invention.

When the number of director elements extends beyond two, additional rules may come into play to determine the spacing and lengths of the director elements in accordance with various aspects of the present invention. For example, FIG. 7 illustrates a second embodiment of a multi-polarized ground plane beam antenna 700, in accordance with various aspects of the present invention. The antenna 700 is tuned to have a 3 dB bandwidth ranging from 2400 MHz to 2500

MHz. The peak gain of the antenna 700 is 17 dBi. The antenna 700 comprises a ground plane 710 which is eighteen inches in length, a reflector element 720, a multi-polarized driven element $D_r$ 730 having three conductive radiative members, and six director elements $D_1$–$D_6$ (740–745). The antenna 700 also includes a reflector plate 750 which is eight inches by eight inches square. The diameters of the various antenna elements are 1/16 inch.

The ground plane 710 is constructed of three conductive sheets each being one inch wide and eighteen inches long. The first conductive sheet 721 serves as a base for the various antenna elements 720, 730, and 740–745 which are positioned substantially perpendicular to the first conductive sheet 721. The second and third conductive sheets 722 and 723 are joined at the length-wise edges to the first conductive sheet 721 at 135-degree angles as shown in FIG. 7 to form the ground plane 710.

The reflector plate 750 electrically and mechanically connects to the ground plane 710 at the reflector element side of the ground plane 710. The reflector plate 750 is substantially perpendicular to the length-wise direction of the ground plane 710. One end of the reflector element 720 and the director elements 740–745 are electrically connected to the ground plane 710 such that the reflector element 720 and director elements 740–745 are co-linear along the length-wise dimension of the ground plane 710. The driven element 730 is positioned co-linearly between the reflector element 720 and the first director element 740 and is electrically isolated from the ground plane 710.

The spacing between the reflector plate 750 (i.e., the first end of the ground plane 710) and the reflector element 720 is 1/4 inch. The spacing between the reflector element 720 and the driven element $D_r$ 730 is one inch. The spacing between the driven element $D_r$ 730 and the first director element $D_1$ 740 is one inch. The spacing between the first director element $D_1$ 740 and the second director element $D_2$ 741 is one inch. The spacing between the second director element $D_2$ 741 and the third director element $D_3$ 742 is 1½ inches. The spacing between the third director element $D_3$ 742 and the fourth director element $D_4$ 743 is ¾ inches. The spacing between the fourth director element $D_4$ 743 and the fifth director element $D_5$ 744 is 1¾ inches. The spacing between the fifth director element $D_5$ 744 and the sixth director element $D_6$ 745 is one inch. The spacing between the sixth director element $D_6$ 745 and the second end of the ground plane 720 is 9¾ inches.

The length of the reflector element 720 is 1 13/32 inches. The length of the first director element $D_1$ 740 is 29/32 inches. The length of the second director element $D_2$ 741 is 26/32 inches. The length of the third director element $D_3$ 742 is 27/32 inches. The length of the fourth director element $D_4$ 743 is 23/32 inches. The length of the fifth director element $D_5$ 744 is 24/32 inches. The length of the sixth director element $D_6$ 745 is 21/32 inches. The lengths of the three conductive radiative members of the driven element $D_r$ 730 are respectively 28/32 inches, 30/32 inches, and 26/32 inches.

Figure 8:
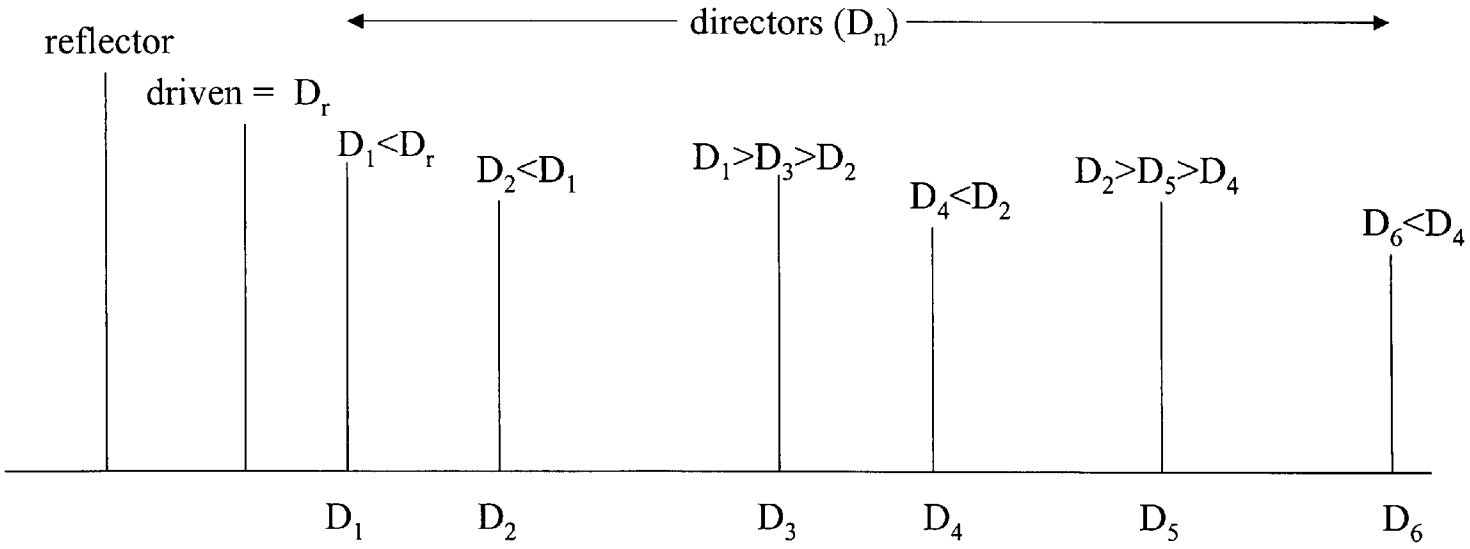
FIG. 8 is an exemplary illustration of a method to generate the relative initial lengths of the antenna elements of the antenna of FIG. 7, in accordance with an embodiment of the present invention.

FIG. 8 is an exemplary illustration of a method to generate the relative initial lengths of the antenna elements of the antenna 700 of FIG. 7, in accordance with an embodiment of the present invention. A director element may be an odd-numbered director element (e.g., $D_1$, $D_3$, $D_5$) or an even-numbered director element (e.g., $D_2$, $D_4$, $D_6$). For "odd" being an odd integer greater than one, the following primary rule applies. The length of an odd numbered director element $D_{odd}$ is greater than the length of a first adjacent even numbered director element $D_{odd-1}$, and the length of a second adjacent even numbered director element $D_{odd+1}$ is less than the length of the first adjacent even numbered director element $D_{odd-1}$. For example, referring to FIG. 8, the length of $D_3$ is greater than the length of $D_2$, and the length of $D_4$ is less than the length of $D_2$.

Additional benefits are seen when other rules are also applied. For example, another rule, in accordance with an embodiment of the present invention, states that, the spacing between director elements $D_{odd}$ and $D_{odd-1}$ is greater than the spacing between director elements $D_{odd-1}$ and $D_{odd-2}$. For example, if $D_{odd}$ is $D_3$ then, according to the rule, the spacing between $D_3$ and $D_2$ should be greater than the spacing between $D_2$ and $D_1$. Referring to FIG. 7, the spacing between $D_3$ and $D_2$ is 1.5 inches which is indeed greater than the spacing between $D_2$ and $D_1$ which is one inch. Also, the spacing between D5 and D4 is 1.75 inches which is indeed greater than the spacing between D4 and D3 which is 0.75 inches.

Another rule, in accordance with an embodiment of the present invention, states that, for "odd" being an odd integer greater than one, the length ($D_{odd}$–$D_{odd-1}$) is less than the length ½*($D_{odd-2}$–$D_{odd-1}$). For example, the length ($D_3$–$D_2$)=(27/32–26/32)=1/32 is less then ½*($D_1$–$D_2$)=½*(29/32–26/32)=½*(3/32)=(1.5)/32. Also, the length ($D_5$–$D_4$)=(24/32–23/32)=1/32 is less than ½*($D_3$–$D_4$)=½*(27/32–23/32)=2/32.

Another rule, in accordance with an embodiment of the present invention, states that, for "odd" being an odd integer greater than one, the spacings between director elements $D_{odd}$ and $D_{odd-1}$, and $D_{odd-2}$ and $D_{odd-1}$ increase the further the director elements get from the driven element $D_r$. For example, the spacing between $D_5$ and $D_4$ is 1.75 inches and is greater than the spacing between $D_3$ and $D_2$ which is 1.5 inches. Also, the spacing between $D_5$ and $D_6$ is 1.0 inch which is greater than the spacing between $D_3$ and $D_4$ which is ¾ inch.

The above rules apply even for antennas having more than six director elements.

Parasitic elements may be added or removed to create alterations (of $D_{odd}$ vs $D_{odd+/-1}$ designations) but maintaining the general nature of essentially co-linearly parasitic beam (stacked) additives.

FIG. 9 is a graphical illustration of the far-field azimuth beam pattern 910 and elevation beam pattern 920 generated by the antenna 700 of FIG. 7, in accordance with various aspects of the present invention. The azimuth dimension is in a plane parallel to the first conductive sheet 721 of the ground plane 710 and includes the first conductive sheet 721. The elevation direction is in a plane perpendicular to the first conductive sheet 721 of the ground plane 710 and includes the co-linear antenna elements 720 and 740–745.

Referring to the azimuth antenna pattern 910, it may be seen that the directivity of the pattern 910 is substantially along a direction corresponding to 0 degrees and falls off rapidly as 30 degrees and 330 degrees is approached, forming a far-field azimuth beam of RF radiation 911 as generated by the ground plane beam antenna 700 (40 degree azimuth half-power (3 dB) beam width).

Similarly, referring to the elevation antenna pattern 920, it may be seen that the directivity of the pattern 920 is substantially along a direction between 0 degrees and 30 degrees, forming a far-field elevation beam of RF radiation 921 as generated by the ground plane beam antenna 700. Again, the peak gain of the antenna 700 is 17 dBi along a direction of maximum directivity. In accordance with an embodiment of the present invention, this direction of maximum directivity corresponds to 0 degrees in azimuth and 8 degrees in elevation (25 degree elevation half-power (3 dB) beam width).

FIGS. 10A and 10B illustrate point-to-point and point-to-multipoint applications using the antenna 700 of FIG. 7, in accordance with various aspects of the present invention. FIG. 10A shows a first multi-polarized ground plane beam antenna 1001 of the type shown in FIG. 7 being enclosed in a triangular housing. The antenna 1001 is mounted to a tower 1010. An omni-directional multi-polarized antenna 1020 is positioned up to one mile from the tower 1010 and may be connected to, for example, a wireless card in a portable personal computer (PC). A second multi-polarized ground plane beam antenna 1030 is positioned up to 10 miles away from the tower 1010 on, for example, a second tower. The antenna 1001 is able to communicate with the other two antennas 1020 and 1030 (i.e., point-to-multipoint), even with some obstruction occurring between the antennas (e.g., trees or buildings). In accordance with an embodiment of the present invention, the antennas 1001, 1020, and 1030 are each able to accept up to 100 watts of power from a transmitter within the frequency range (2400 MHz–2500 MHz) of the antennas. In practice, the antennas 1001 and 1030 may be tilted slightly downward to account for the positive take-off angles of the radiation patterns.

FIG. 10B illustrates a point-to-point application with a first multi-polarized ground plane beam antenna 1040 of the type shown in FIG. 7 being enclosed in a triangular housing and mounted on a first tower 1050, and a second multi-polarized ground plane beam antenna 1060 of the type shown in FIG. 7 being enclosed in a triangular housing and mounted on a second tower 1070. The two antennas face each other and are mounted at the same elevation being up to 20 miles apart. The two antennas are able to communicate with each other (i.e., point-to-point), even with some obstruction occurring between the antennas (e.g., trees or buildings). In accordance with an embodiment of the present invention, the antennas 1040 and 1060 are each able to accept up to 100 watts of power from a transmitter within the frequency range (2400 MHz–2500 MHz) of the antennas. In practice, the antennas 1040 and 1060 may be tilted slightly downward to account for the positive take-off angles of the radiation patterns.

Indoor and outdoor obstructions can produce reflections, diffractions, refractions, and scattering of radio waves. The multi-polarized antennas of FIG. 1 and FIG. 7 are able to receive all polarizations and capture the changing, highly preferred (i.e., best polarization) pathway signal, holding the communication where standard antennas fall short.

With each side of a communication link using the antennas of FIG. 1 or FIG. 7, signals of all polarizations are produced upon transmission. These multiple signals may all be received and, due to the geometric design of the antennas, a plurality of the multiple signals tend to add together in phase in line-of-sight (LOS) and non-line-of-sight (NLOS) (where maximum signal is still of a direct point-to-point pathway and there is a most preferred maximum penetration polarization) scenarios upon reception. Any singularly polarized noise from out-of-phase multi-path or signals from other sources account for just a small part of the total.

Figure 11:
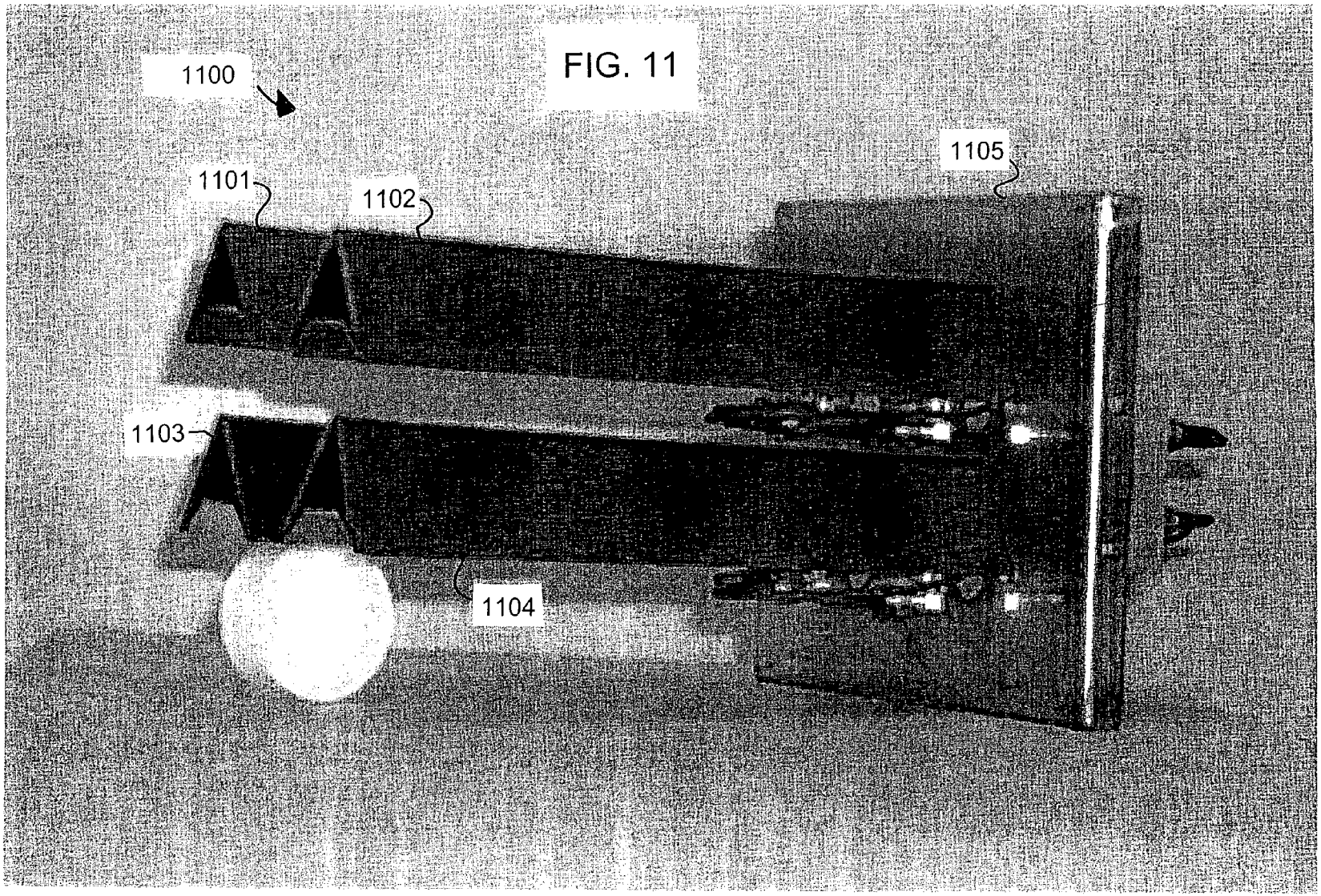
FIG. 11 is an illustration of an embodiment of a stacked configuration comprising four of the multi-polarized ground plane beam antennas 700 of FIG. 7, in accordance with various aspects of the present invention.

FIG. 11 is an illustration of an embodiment of a stacked configuration 1100 comprising four of the multi-polarized ground plane beam antennas 700 of FIG. 7, in accordance with various aspects of the present invention. The stacked configuration comprises four multi-polarized ground plane beam antennas 1101–1104 each housed in a triangular housing and mounted, having substantially the same orientation, to a common reflector plate 1105 such that the four similar ends of the antennas 1101–1104 reside at the four corners of an imaginary square in a plane. The reflector element sides of the antennas 1101–1104 are mounted to the reflector plate 1105.

The vertical and horizontal spacing between any two of the antennas 1101–1104 is typically between ⅔ of a wavelength and 3 wavelengths, in accordance with various embodiments of the present invention. More or less spacing still shows spatial capture benefits but probably lesser gain. Each of the four antennas 1101–1104 are fed a radio frequency signal in phase with each other upon transmission to effectively compress, via physical re-direction and accepted resonance properties, the transmitted far-field beam pattern in both azimuth and elevation compared to that of a single beam antenna (i.e., a narrower antenna beam pattern with higher gain is generated with the stacked configuration). Similarly, upon reception, the azimuth and elevation receive antenna patterns are effectively compressed as well.

The stacked configuration 1100 is typically mounted to a mast or tower in accordance with various embodiments of the present invention. The stacked configuration 1100 may be mounted right side up to provide more coverage above the horizontal, or up side down to provide more coverage below the horizontal.

Other alternative stacking configurations may be implemented as well, in accordance with various embodiments of the present invention. For example, four multi-polarized ground plane beam antennas may be stacked co-linearly one on top of the other to generate a narrower compressed beam in the elevation direction. Similarly, four multi-polarized ground plane beam antennas may be stacked co-linearly side-by-side to generate a narrower compressed beam in the azimuth direction.

Figure 12:
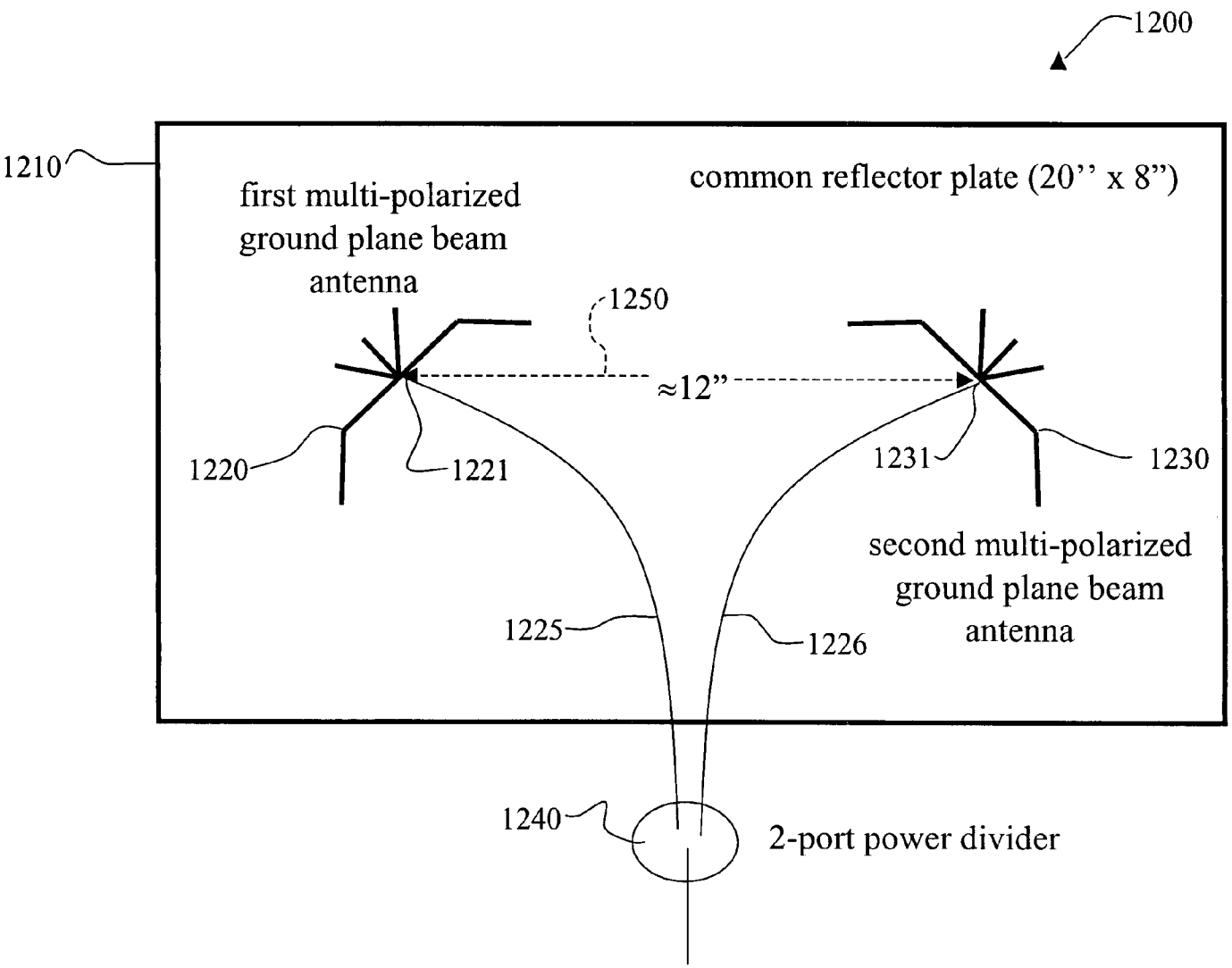
FIG. 12 illustrates an embodiment of a multi-polarized dual ground plane beam antenna using two multi-polarized ground plane beam antennas, in accordance with various aspects of the present invention.

FIG. 12 illustrates an embodiment of a multi-polarized dual ground plane beam antenna 1200 using two multi-polarized ground plane beam antennas, in accordance with various aspects of the present invention. The antenna 1200 comprises a conductive reflector plate 1210, a first multi-polarized ground plane beam antenna 1220, a second multi-polarized ground plane beam antenna 1230, and a two port power divider 1240.

The first multi-polarized ground plane beam antenna 1220 is mounted onto a first side of the conductive reflector plate 1210 such that RF radiation from the first ground plane beam antenna 1220 is directed substantially perpendicular to and away from the first side of the conductive reflector plate 1210. The second multi-polarized ground plane beam antenna 1230 is identical to the first multi-polarized ground plane beam antenna 1220 and is also mounted onto the first side of the conductive reflector plate 1210 such that RF radiation from the second ground plane beam antenna 1230 is directed substantially perpendicular to and away from the first side of the conductive reflector plate 1210.

The two port power divider 1240 is used to feed a radio frequency signal in phase to both the first and second multi-polarized ground plane beam antennas 1220 and 1230 on transmit, and to combine signals received by the two ground plane beam antennas 1220 and 1230 upon receive. The electrical connection between the two-port power divider 1240 and the two ground plane beam antennas 1220 and 1230 may be accomplished via, for example, two coaxial cable connections 1225 and 1226 of equal length. In accordance with an embodiment of the present invention, the two-port power divider 1240 may include a simple T-connector with proper impedance matching coaxial transformers.

In accordance with an embodiment of the present invention, the ground planes 150 (see FIG. 1) of the two-ground plane beam antennas 1220 and 1230 are electrically connected to the reflector plate 1210. Also, the ground plane beam antennas 1220 and 1230 are oriented on the reflector plate 1210 with respect to each other such that the apex points 1221 and 1231 of the respective driven elements 120 (see FIG. 1) of the ground plane beam antennas 1220 and 1230 are separated by a predetermined distance 1250 based on, at least in part, a predetermined radio frequency of operation. Also, the planes of the conductive ground plane sheets 151 (see FIG. 1) of the ground plane beam antennas 1220 and 1230 are oriented to be perpendicular to each other. In accordance with an embodiment of the present invention, the distance 1250 is approximately 12 inches for a radio frequency of operation of 2.4 GHz. Also, the reflector plate 1210 is approximately 20 inches by 8 inches.

The multi-polarized dual ground plane beam antenna 1200 may be rotated to any orientation about the center of the reflector plate 1210 without significantly negatively affecting the resultant main beam of the antenna pattern created by the multi-polarized dual ground plane beam antenna 1200 or the other characteristics of spatial diversity and capture of the preferred polarization path. As a result, the performance of the multi-polarized dual ground plane beam antenna 1200 is highly independent of spatial orientation.

Similarly, single polarized beam antennas can be used in such a manner producing equivalency of polarizations in a single plane (e.g., x-y plane). However, by using the multi-polarized beam antennas in this configuration, further polarization equivalency occurs in the added z-axis (EquiQuaDimentional, a coined term herein), and even further spatial diversity characteristics are seen.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A ground plane beam antenna for transmitting and/or receiving radio frequency (RF) signals, said antenna comprising:

at least one parasitic reflector element having a first end and a second end;

at least one parasitic director element having a first end and a second end;

a driven element positioned co-linearly with and between said at least one reflector element and said at least one director element; and an electrically conductive ground plane being electrically connected to said at least one reflector element and said at least one director element at said second ends, and being electrically isolated from said driven element, the ground plane comprising a first electrically conductive sheet having a width of about ¼ wavelength of a tuned radio frequency.

2. The antenna of claim 1 wherein said driven element comprises at least two radiative members each having a first end and a second end, and wherein said second ends of said radiative members are electrically connected at an apex point and are each disposed outwardly away from said apex point at an acute angle relative to and on a first side of an imaginary plane intersecting said apex point.

3. The antenna of claim 1 further comprising a dielectric material serving to mechanically connect, at least in part, said driven element to said ground plane while electrically insulating said driven element from said ground plane.

4. The antenna of claim 3 further comprising an electrical conductor electrically connected to said driven element at an apex point at which said at least two radiative elements are electrically connected, said electrical conductor extending away from said apex point toward a ground plane side of said antenna through said dielectric material to allow connection to a transmission line for interfacing said driven element to a radio frequency transmitter and/or receiver.

5. The antenna of claim 1 further comprising an electrical connector to allow connection of said driven element and said ground plane to a transmission line.

6. The antenna of claim 2 wherein said ground plane comprises a substantially rectangular conductive sheet being positioned substantially parallel to said imaginary plane.

7. The antenna of claim 1 wherein said ground plane further comprises substantially rectangular second and third electrically conductive sheets, each having a width of about ¼ wavelength of said tuned radio frequency, each being substantially the same length as said first conductive sheet, said second conductive sheet having a first lengthwise edge that is mechanically and electrically connected to a first lengthwise edge of said first conductive sheet and forming an angle with respect to said first conductive sheet, and said third conductive sheet having a first lengthwise edge that is mechanically and electrically connected to a second lengthwise edge of said first conductive sheet and forming an angle with respect to said first conductive sheet.

8. The antenna of claim 7 wherein one-half the width of said first conductive sheet plus the full width of said second conductive sheet or said third conductive sheet is at least one-quarter of a wavelength.

9. The antenna of claim 2 wherein each of said radiative members are substantially linear and have a physical length determined by a pre-defined radio frequency.

10. The antenna of claim 1 wherein said reflector element and said at least one director elements are substantially linear.

11. The antenna of claim 2 wherein said acute angle between each of said radiative members and said ground plane is between 1 degree and 89 degrees.

12. The antenna of claim 1 further comprising a reflector plate being positioned at a reflector element end of said ground plane, being substantially perpendicular to said ground plane, and being mechanically and electrically connected to said ground plane.

13. The antenna of claim 2 wherein said radiative members are equally spaced in angle circumferentially around 360 degrees.

14. The antenna of claim 7 wherein said angle is between zero degrees and 180 degrees.

15. A method to construct a ground plane beam antenna for transmitting and/or receiving radio frequency (RE) signals, said method comprising:

generating a driven element that is tuned to at least one predetermined radio frequency;

generating at least one linear, parasitic reflector element having a first end and a second end and having an initial length based on, at least in part, said tuned driven element;

generating at least one linear, parasitic director element having a first end and a second end and having an initial length based on, at least in part, said tuned driven element;

positioning said driven element co-linearly with and between said at least one reflector element and said at least one director element;

generating an electrically conductive ground plane, the ground plane comprising a first electrically conductive sheet having a width of about ¼ wavelength of at least one predetermined radio frequency; and electrically connecting said ground plane to said second ends of said reflector element and said at least one director element and keeping said ground plane electrically isolated from said driven element.

16. The method of claim 15 wherein said driven element comprises at least two radiative members each having a first end and a second end and wherein said second ends of said radiative members are electrically and mechanically connected at an apex point such that each radiative member is disposed outwardly away from said apex point at an acute angle relative to and on a first side of an imaginary plane intersecting said apex point.

17. The method of claim 15 further comprising adjusting said initial lengths of at least one of said at least one reflector element, said driven element, and said at least one director element based on a diameter of at least one of said elements.

18. The method of claim 15 further comprising adjusting said initial lengths of at least one of said at least one reflector element, said at least one director element, and said driven element based on an analysis of electro-magnetic interactions between said elements.

19. The method of claim 16 wherein generating said tuned driven element comprises cutting each of said radiative members to a physical length corresponding to said at least one predetermined radio frequency.

20. The method of claim 16 further comprising mechanically connecting said driven element to said ground plane using at least a dielectric material to electrically insulate said driven element from said ground plane.

21. The method of claim 20 further comprising connecting an electrical conductor to said driven element at said apex point such that said electrical conductor extends away from said apex point toward a ground plane side of said antenna and through said dielectric material to allow connection to a transmission line for interfacing said driven element to a radio frequency transmitter and/or receiver.

22. The method of claim 15 further comprising connecting an electrical connector to said driven element and said ground plane to allow connection of said antenna to a transmission line.

23. The method of claim 15 wherein said ground plane comprises a substantially rectangular conductive sheet being substantially parallel to said imaginary plane.

24. The method of claim 23 wherein said ground plane further comprises substantially rectangular second and third electrically conductive sheets, each having a width of about ¼ wavelength of said at least one predetermined radio frequency, each being substantially the same length as said first conductive sheet, said second conductive sheet having a first lengthwise edge that is mechanically and electrically connected to a first lengthwise edge of said first conductive sheet and forming an angle with respect to said first conductive sheet, and said third conductive sheet having a first lengthwise edge that is mechanically and electrically connected to a second lengthwise edge of said first conductive sheet and forming an angle with respect to said first conductive sheet.

25. The method of claim 24 wherein one-half the width of said first conductive sheet plus the full width of said second conductive sheet or said third conductive sheet is at least one-quarter of a wavelength.

26. The method of claim 16 wherein said at least one predetermined radio frequency is substantially the same for each of said radiative members.

27. The method of claim 16 wherein said at least one predetermined radio frequency is substantially different for each of said radiative members.

28. The method of claim 16 wherein an angle between each of said radiative members and said ground plane is between 1 degree and 89 degrees.

29. The method of claim 15 further comprising positioning a reflector plate at a reflector element end of said ground plane and substantially perpendicular to said ground plane, and being mechanically and electrically connected to said ground plane.

30. The method of claim 16 wherein said radiative members are equally spaced in angle circumferentially around 360 degrees.

31. The method of claim 15 wherein a first spacing between a first odd numbered director element $D_{odd}$ of said at least one director element and an adjacent even numbered director element $D_{odd-1}$ of said at least one director element is greater than a second spacing between said even numbered director element $D_{odd-1}$ and an adjacent second odd numbered director element $D_{odd-2}$ of said at least one director element.

32. The method of claim 15 wherein a first difference in length between a first odd numbered director element $D_{odd}$ of said at least one director element and an adjacent even numbered director element $D_{odd-1}$ of said at least one director element is less than one-half a second difference in length between a second odd numbered director element $D_{odd-2}$ of said at least one director element and said adjacent even numbered director element $D_{odd-1}$.

33. The method of claim 15 wherein a first linear spacing between a first odd numbered director element $D_{odd}$ of said at least one director element and an adjacent even numbered director element $D_{odd-1}$ of said at least one director element increases as $D_{odd}$ is further in linear distance from said driven element.

34. The method of claim 33 wherein a second linear spacing between a second odd numbered director element $D_{odd-2}$ of said at least one director element and said adjacent even numbered director element $D_{odd-1}$ increases as $D_{odd-2}$ is further in linear distance from said driven element.

35. The method of claim 15 wherein a length of an odd numbered director element $D_{odd}$ of said at least one director element is greater than a length of a first adjacent even numbered director element $D_{odd-1}$ of said at least one director element, and a length of a second adjacent even numbered director element $D_{odd+1}$ of said at least one director element is less than said length of said first adjacent even numbered director element $D_{odd-1}$.

* * * * *